United States Patent [19]

Sasaki

[11] 4,234,121

[45] Nov. 18, 1980

[54] CONTAINER FOR LIQUID

[76] Inventor: Toshihiko Sasaki, 2-26 Asahigaoka, Nerimaku, Tokyo, 176, Japan

[21] Appl. No.: 25,888

[22] Filed: Apr. 2, 1979

[51] Int. Cl.[3] ..... B65D 41/02; B65D 43/02

[52] U.S. Cl. ..... 229/1.5 B; 220/359; 206/813; 229/43; 229/48 SB

[58] Field of Search ..... 229/1.5 R, 1.5 B, 43, 229/48 SB; 206/813; 220/359

[56] References Cited

U.S. PATENT DOCUMENTS

| | | | |
|---|---|---|---|
| 2,060,781 | 11/1936 | Annen | 229/1.5 B |
| 2,213,666 | 9/1940 | Burke | 229/48 SB |
| 2,500,549 | 3/1950 | Ketay | 229/48 SB |
| 3,079,057 | 2/1963 | Colarusso | 229/43 |
| 3,488,201 | 1/1970 | Pizarro | 229/43 |
| 3,547,305 | 12/1970 | Khoury | 220/359 |
| 3,817,417 | 6/1974 | Edwards | 229/43 |

FOREIGN PATENT DOCUMENTS

| | | | |
|---|---|---|---|
| 1176291 | 1/1970 | United Kingdom | 229/43 |

*Primary Examiner*—George E. Lowrance

*Attorney, Agent, or Firm*—Merriam, Marshall & Bicknell

[57] ABSTRACT

A combination of a container and a lid is disclosed. The container has an open top and a frusto-conical or cylindrical side wall. The lid is formed with a tongue and provided with an adhesive layer on one side thereof. A release is fixed to the outside of the side wall of the container so that the lid is normally attached releasably thereto.

4 Claims, 4 Drawing Figures

CONTAINER FOR LIQUID

BACKGROUND OF THE INVENTION

This invention relates to a container and a lid combined therewith so that the container may be adapted to contain liquid, particularly urine, for medical examination.

In urine examination or analysis, containers with a wide opening and generally without a lid have conventionally been used to contain the liquid. Such open containers are likely to allow dust or other foreign substances to be contained in the liquid and, if the container is moved about or falls down, the liquid may flow out.

SUMMARY OF THE INVENTION

It is an object of the invention to provide a novel combination of a container and a lid which is normally adhered releasably to a side wall of the container and can be adhered to the opening of the container or hermetically and sanitarily seal it until the liquid filled in the container is examined.

To this end, the present invention comprises a container having an open top and a cup-like or frusto-conical or cylindrical side wall, on which a release member is attached, and a lid having a tongue or radial projection and an adhesive layer on one side thereof normally for releasable attachment of the lid to the release member on the container.

BRIEF EXPLANATION OF THE DRAWINGS

The invention will be described hereinafter in detail by way of preferred embodiments with reference to the accompanying drawings, wherein.

DETAILED DESCRIPTION OF THE INVENTION

Figure 1:
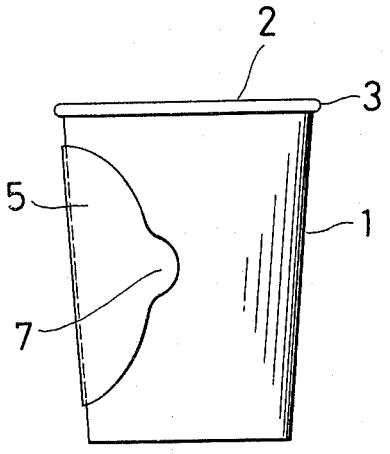
FIG. 1 is a side view of the container with the lid, before use, according to this invention.

A cup-shaped container 1 made of paper or another material has a frusto-conical or cylindrical side wall and a top opening 2 with a peripheral extension 3 curled outside or a radial or horizontal flange around the opening 2. The inside of the paper container 1 and the outside of the extension 3 are coated or processed with a waterproof material. A paper lid 5 is shaped and sized enough to cover the opening 2 and the extension 3 and has at least one tongue or radial extension 7. One side of lid 5 may be used for marking or identification etc. thereon while the other side has a layer 6 of pressure sensitive binding agent or adhesive provided thereon except the tongue 7. Attached to the outside of the side wall of the container 1 is a release or strippable backing material 4 which is sized and shaped corresponding to the lid 5 and may be made of paper laminated with polyethylene and further processed with silicone. Lid 5 is normally held on the side wall of the container with its adhesive layer 6 fitted on the release 4, as shown in FIG. 1.

Figure 2:
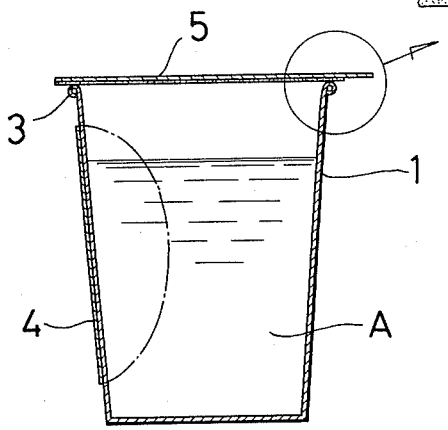
FIG. 2 is a longitudinal section of the container and the lid in use.
Figure 4:
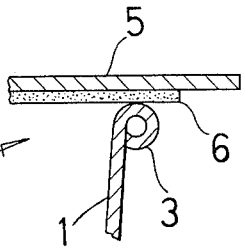
FIG. 4 is an enlarged view of a part of FIG. 2.
Figure 3:
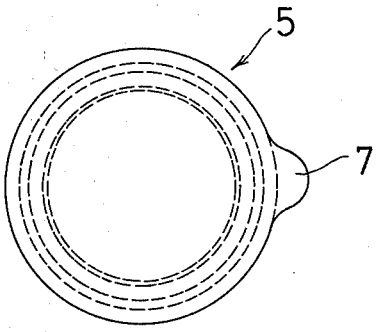
FIG. 3 is a top plan view of FIG. 2.

In use, after the container 1 is filled with liquid A, the lid 5 is peeled or removed from the side wall of the container by pulling the adhesive-free tongue 7 and placed over the top of the container with the adhesive layer 6 facing the peripheral extension 3, as shown in FIG. 2, so that the adhesive sticks to the extension, thus hermetically or liquid-tightly sealing the opening 2. To take out the liquid from the container, the lid 5 may be removed or partly peeled off or otherwise pierced. A plurality of such containers each having the lid on the side wall can be piled up with one into another in a minimum space for storage.

After used, the paper container 1 and paper lid 5 may be easily incinerated.

What is claimed is:

1. A combination of a container and a lid, said container having an open top and a side wall, said lid being sized and shaped to cover said top and formed with at least one radial extension, and said lid having a pressure sensitive adhesive layer provided on one side thereof over at least an area to cover said top but except said extension, the dimension of said side wall being at least as great as the width of said cover so that said cover may normally be attached releasably to said side wall by said adhesive layer, and a strippable backing material sized and shaped corresponding to said lid and fixed to the outside of said side wall for releasable attachment of said lid, whereby during shipment or storage said lid is attached by said adhesive to said backing material on said side and in use said lid is stripped from said backing material and attached by said adhesive to said top.

2. A combination as in claim 1, wherein said top of said container has a peripheral extension curled outside.

3. A combination as in claim 1, wherein said top has a radial flange.

4. A combination of a container and a lid, said container having an open top and a side wall, said lid being sized and shaped to cover said top and formed with at least one radial extension, a strippable backing material sized and shaped corresponding to said lid being fixed to the outside of said side wall, the dimension of said side wall being at least as great as the width of said release and said cover, and said lid having a pressure sensitive adhesive layer provided on one side thereof over at least an area to cover said top but except said extension, and said lid being attached by said adhesive to said backing material but being removable by pulling on said extension, whereby during shipment or storage said lid is attached by said adhesive to said backing material on said side and in use said lid is stripped from said backing material and attached by said adhesive to said top.

* * * * *